United States Patent [19]

Oldfield

[11] Patent Number: 5,047,737

[45] Date of Patent: Sep. 10, 1991

[54] DIRECTIONAL COUPLER AND TERMINATION FOR STRIPLINE AND COAXIAL CONDUCTORS

[75] Inventor: William W. Oldfield, Redwood City, Calif.

[73] Assignee: Wiltron Company, Morgan Hill, Calif.

[21] Appl. No.: 262,473

[22] Filed: Oct. 25, 1988

Related U.S. Application Data

[62] Division of Ser. No. 176,100, Mar. 31, 1988, abandoned.

[51] Int. Cl.[5] ..... H01P 1/26

[52] U.S. Cl. ..... 333/22 R; 333/245; 333/246; 338/216

[58] Field of Search ..... 333/22 R, 34, 246, 245; 338/216

[56] References Cited

U.S. PATENT DOCUMENTS

| | | | |
|---|---|---|---|
| 2,438,915 | 4/1948 | Hansen | 333/22 R |
| 3,209,284 | 9/1965 | Hast | 333/22 R X |
| 3,354,412 | 11/1967 | Steidlitz | 333/22 R |
| 3,621,479 | 11/1971 | Peterson et al. | 333/22 R |
| 3,678,417 | 7/1972 | Ragan | 333/22 R |
| 3,775,706 | 11/1973 | Jones et al. | 333/22 R |
| 3,790,904 | 2/1974 | Lesgk et al. | 333/34 X |
| 4,267,531 | 5/1981 | Spinner et al. | 333/22 R |

FOREIGN PATENT DOCUMENTS

| | | | |
|---|---|---|---|
| 2634812 | 2/1978 | Fed. Rep. of Germany | 333/22 R |
| 232702 | 10/1986 | Japan | 333/22 R |
| 1109833 | 8/1984 | U.S.S.R. | 333/22 R |

*Primary Examiner*—Eugene R. LaRoche
*Assistant Examiner*—Benny Lee
*Attorney, Agent, or Firm*—Fliesler, Dubb, Meyer & Lovejoy

[57] ABSTRACT

A directional coupler having coupled striplines provided between ground planes includes dielectric layers having a dielectric constant greater than the dielectric constant of air interposed between the stripline conductors and each of the ground planes, thereby equalizing the propagation velocity of the odd and even modes to improve the directivity of the coupler. A planar termination for a coaxial conductor provides a soft mode change from the coaxial transmission mode to the TEM suspended substrate planar mode of the resistive element in the termination by inserting a planar resistive element into a slot in the coaxial conductor. The soft mode change reduces the reflections associated with a mode change, providing a planar termination which is easier to design and fabricate than a coaxial termination to be utilized. A planar termination for a stripline supports the stripline when used in a directional coupler and has a planar resistive element rotated ninety degrees with respect to the plane of the stripline so that there is no mode change between the stripline and the planar resistive element.

11 Claims, 5 Drawing Sheets

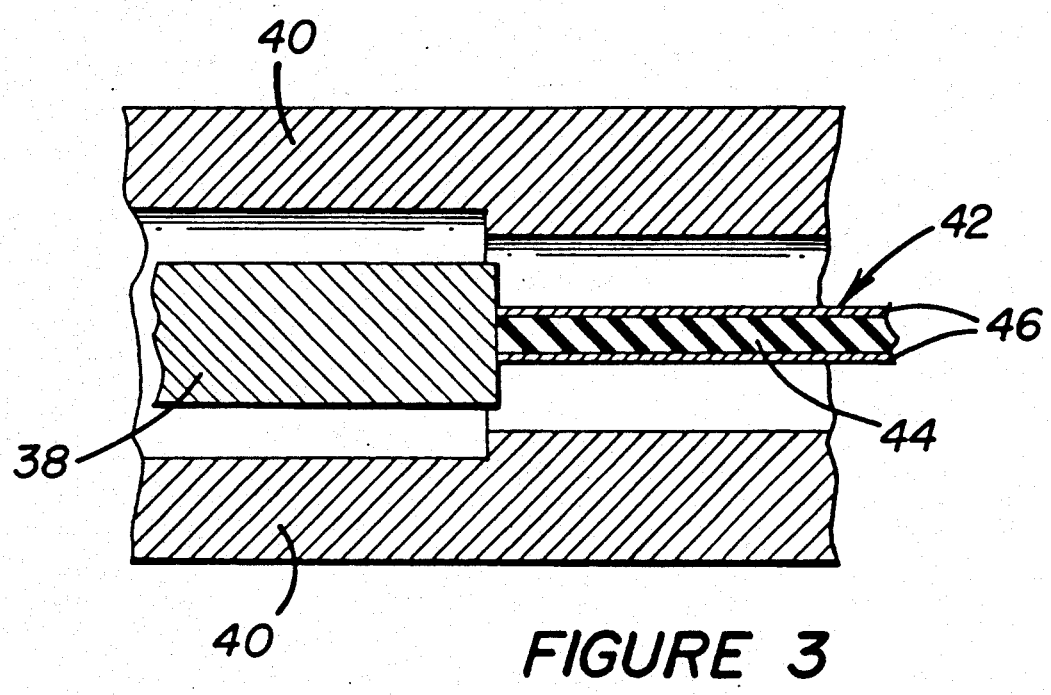
FIGURE 3
(PRIOR ART)
FIGURE 2
(PRIOR ART)
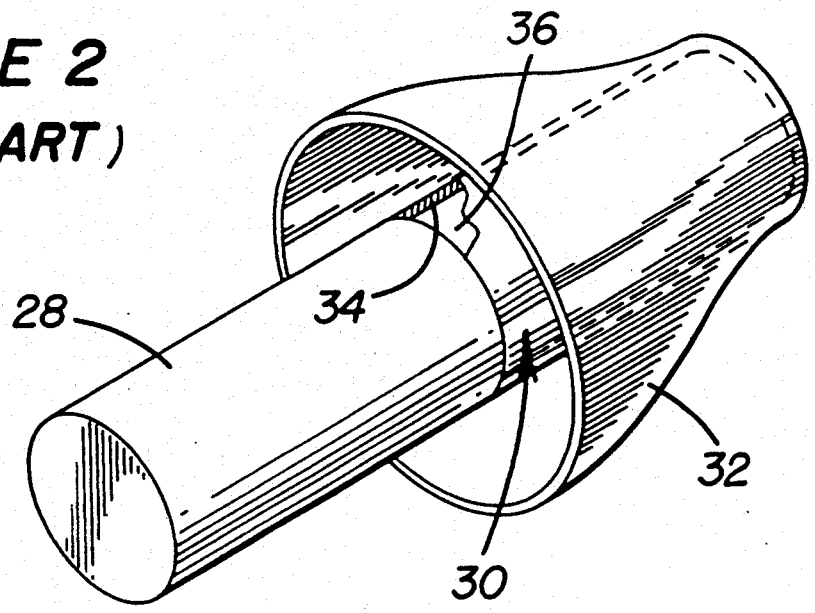

DIRECTIONAL COUPLER AND TERMINATION FOR STRIPLINE AND COAXIAL CONDUCTORS

This is a divisional application of copending application Ser. No. 176,100, filed Mar. 31, 1988, now abandoned.

BACKGROUND OF THE INVENTION

1. Field of the Invention

The present inventions relate to directional couplers and terminations for coaxial and stripline conductors.

2. Description of the Related Art

Directional couplers are useful measurement tools which provide a simple, convenient, accurate means for sampling microwave energy. Directional couplers also provide the ability to separate forward from reflected power.

FIG. 1 illustrates the basic construction of a conventional coupled-line directional coupler 10 useful in, for example, microwave applications. The directional coupler 10 consists of first and second parallel striplines 11, 12 coupled over multiples of approximately one-quarter wavelength ($\lambda/4$). Ports A and B are connected to first stripline 11 and port D and port C are connected to the second stripline 12.

The first and second parallel striplines 11, 12, referred to respectively as main and auxiliary lines, are separated from each other except in a coupling region 26. Ports A–C are usually configured for connection to coaxial transmission lines and the outer conductor or ground for each coaxial line is connected to grounded body 22 of coupler 10. Port D 18 terminates the second stripline 12 by interconnecting stripline 12 to the body 22 of coupler 10, which is at ground potential, through resistor 24.

In the coupling region 26, energy applied to main line 11 is directionally coupled from the main line 11 to the auxiliary line 12 and vice versa. In particular, energy applied at port A of the main line 10 appears at port B of main line 11; however, some fraction of the energy will appear at port C of the auxiliary line 12. The amount of energy appearing at port C of auxiliary line 12 depends upon the amount of coupling provided in the design of the unit. Several factors, including the spacing between lines 11, 12, determine the amount of energy that may be transferred from the one line 11, 12 to the other. The amount of coupling desired for forward power—power flowing in the port A-to-port-B direction—varies with the application. For example, a coupler used to split a signal would use a large amount of coupling. Coupling values from 3 dB to beyond 30 dB are typically encountered in practice.

Energy applied to port B of main line 10 will appear at port A, but practically none of this energy will appear at port C. The degree of discrimination in auxiliary line 12 between energy flowing in the port B-to-port-A direction and energy flowing in the port A-to-port-B direction is the directivity of the coupler. Directivity is calculated as the ratio of the forward-to-reverse coupling, expressed in dB, and is a measure of isolation obtainable at coupled port C with power being fed into the main line 11 at port B. The intention is to ensure that a minimum of the energy flowing in the port B-to-port-A direction will reach a load connected to port C of the auxiliary line 12, and thus the ideal directional coupler will have an infinite value of directivity. Values of directivity are usually low, on the order of 5 to 30 dB.

A directional coupler is also a useful device for measuring reflected energy. This is accomplished by applying energy to port B and connecting a device under test at port A. Energy reflected by the device under test will flow in the port A-to-port-B direction and a known fraction thereof will appear at port C.

All parallel-line couplers, whether true TEM or quasi-TEM, have an odd mode and an even mode property which results in odd and even mode impedances $Z_{Oo}$ and $Z_{Oe}$. Directional couplers operating in the true TEM mode ideally yield equal phase velocities for the odd and even modes; however, most true TEM mode directional couplers, as well as quasi-TEM transmission lines (for example, microstrips) and other structures, yield different odd mode and even mode phase velocities, $v_{po}$ and $v_{pe}$.

The propagation velocity (or phase velocity) $v_p$ of a wave traveling along a transmission line is $$v_p = \frac{1}{\sqrt{LC}} = \frac{c}{\sqrt{\mu_r \epsilon_r}}$$

where L is the inductance of the transmission line, C is the capacitance of the transmission line, $\mu_r$ and $\epsilon_r$ are the permeability and permittivity of the medium through which the wave passes, and c is the velocity of light in free space. Most transmission lines do not comprise any ferromagnetic materials, and thus $\mu_r = 1$. Accordingly, for a uniform dielectric surrounding a conductor $$v_p = c/\sqrt{\epsilon_r}\,.$$

Coupled striplines 11, 12 of conventional directional couplers are constructed using metalized plastic layers similar to multi-layer printed circuit board. The metal is etched to form a desired conductor or circuit pattern. Very small, high-frequency geometries can be formed this way; however, the radio frequency (RF) performance is never very good because of three major problem areas: First, the dimensional tolerance (particularly the thickness) of the plastic layers is large; second, it is difficult to provide connections from the stripline structure to coaxial connectors with little RF reflection, especially at the terminated port, port D 18 which is largely responsible for the directivity of the coupler; and third, small air gaps between the layers of plastic contribute to differing propagation velocities of the odd and even TEM modes. In the case of conductors formed of metalized plastic layers, the non-uniformity of the dielectric causes the transmission lines to have differing odd and even mode propagation velocities, i.e., $v_{po} \neq v_{pe}$. The difference in the propagation or phase velocities of the odd and even modes degrades directivity. Differing propagation velocities of the odd and even modes have several causes, and thus result even if the dielectric medium which supports the striplines 11, 12 is uniform.

For parallel-coupled microstrips a dielectric overlay of substrate-type dielectric material can be provided in the region over the coupled microstrip lines. This dielectric overlay is useful for reducing the odd-mode phase velocity. See, T. C. Edwards, *Foundations of Microstrip Design*, John Wiley & Sons, p. 151. However, microstrip couplers, even those utilizing dielectric overlays, do not provide satisfactory results. In particular, the propagation velocities $v_{pe}$ and $v_{po}$ are dependent on frequency, and the geometry of the microstrips, causing a phenomenon known as dispersion. These problems relate to the fact that with microstrips, including those having dielectric overlays, the electric fields pass from air to another dielectric. Accordingly, the propagation velocity is dependent on some combination or average of $\epsilon_0$ and $\epsilon_r$, where $\epsilon_r$ is the permittivity of the dielectric.

Another type of construction for the striplines 11, 12 is a relatively thick self-supporting metal where the air surrounding the striplines is the dielectric. The shape of a self-supporting metal stripline is usually provided by machining the stripline in a step-like fashion (see FIG. 6) providing so-called stepped striplines. These steps in the striplines correspond to quarter wavelength sections and are another factor which causes the odd and even modes to have different propagation velocities. Although it is possible to manufacture self-supporting metal striplines with a smooth taper as opposed to steps, the design and manufacture of such striplines is very difficult.

The designation, as used herein, stripline refers to any conductor which has infinite ground planes on both sides of the conductor. The conductor itself may have different shapes, e.g., round or rectangular. This structure is difficult to construct for high-frequency applications because of the necessary small size of the striplines and tight tolerances. Fabricating a round conductor having quarter wavelength sections is particularly difficult Indeed, until 1984, it was believed that the maximum frequency which could be handled by coaxial couplers was 26 GHz. This perceived limitation was related, at least in part, to the inability to manufacture components such as couplers with the small dimensions and tolerances required for frequencies above 26 GHz. Tolerances on the order of approximately 0.0005" must be maintained for frequencies over 26 GHz.

Port D 18 includes a termination which ideally absorbs all of the RF energy impinged thereon. FIG. 2 shows a conventional termination for a coaxial conductor. A conductor 28, which may be the centerline of a coaxial transmission line or a stripline in a directional coupler, is connected to a resistor 30 provided between conductor 28 and the outer conductor of a coaxial transmission line or other ground plane 32. The outer conductor or ground plane 32 must be precisely shaped to effectively transform from $Z_0$ (the coaxial or conductor impedance) to zero impedance at the ground end. In particular, the distance between the outer conductor 32 and resistor 30 and the rate of change in this distance is important. Conventional resistors 30 are rod-shaped and have a diameter approximately the same as the diameter of the coaxial conductor; such resistors 30 are fabricated by providing a resistive film 34 on a ceramic rod 36. However, it is difficult to provide precise ceramic rods 36—again dimensions and tolerances are important—and to provide a uniform and mechanically accurate resistive film 34.

The quality of a coaxial termination depends in large part on the following factors: (1) the DC value of the resistor and the variation of this value with time and temperature; (2) the RF design of each element in order to have a minimum reflection; and (3) the ability to have close mechanical tolerances during manufacturing—any deviation from the perfect RF design causes reflection.

Conventional "rod" resistors 30 present problems with respect to all three of these factors, particularly in designs for higher frequencies which necessitate small components. Further, it is difficult to connect such resistors to the centerline conductor of a coaxial transmission line. The small dimensions required for high-frequency RF applications make it nearly impossible to manufacture the outer conductor 32 in the required shape.

To avoid the problems associated with conventional rod-shaped resistors 30 and ground planes 32 having a circular cross-section, planar resistors have been used for coaxial terminations. However, with a planar resistor the conductor is not coaxial and the RF waves must undergo a mode change from coaxial to planar at the junction of the coaxial centerline and the planar resistor. Such mode changes have conventionally been abrupt (or hard) mode changes.

FIG. 3 illustrates the structure which causes a conventional hard mode change when a transmitted signal passes between a coaxial conductor having a centerline conductor 38 and a ground plane or outer conductor 40 and a planar conductor, for example, a planar resistor 42 having a substrate 44 with resistive films 46 provided on the substrate 44. A hard or abrupt mode change causes a fairly large reflection, thereby degrading the quality of the RF termination.

An additional problem with conventional directional couplers and terminations is that it is difficult to support metal striplines which utilize an air dielectric. This problem is compounded at port D 18 where the stripline 12 is connected to a termination. Conventionally, a support mechanism is provided between the stripline 12 and the ground body 22 of a coupler to support stripline 12. Such support mechanisms almost always cause reflections of the signals transmitted by stripline 12. In addition, support mechanisms require mode changes from stripline to the coaxial mode of the support mechanism and the termination. A conventional termination as shown in FIG. 2 is connected to the support mechanism.

SUMMARY OF THE INVENTION

It is, therefore, an object of the present invention to provide a coupler having equalized even-mode and odd-mode propagation velocities, and thus a large or high directivity.

A further object of the present invention is to provide a directional coupler which is useful at high frequencies—particularly frequencies between 26 GHz and 40 GHz and beyond—with improved directivity.

Another object of the present invention is to provide a termination which has a low RF reflectivity.

Another object of the present invention is to provide a termination for a stripline conductor which is also useful as a support for a stripline conductor in a directional coupler.

Another object of the present invention is to provide a termination for a coaxial conductor utilizing a planar resistive element and having a soft-mode change between the circular coaxial conductor and the planar resistive element.

A termination in accordance with the present invention for a conductor having a terminal end and a slot provided in the terminal end comprises first and second parallel planar ground planes, and a planar resistive element provided between the planar ground planes and inserted into the slot in the conductor for electrically interconnecting the conductor and the ground planes. The resistive element includes a substrate having a first portion which is inserted into the slot in the conductor and a second portion, a conductive coating on the first portion of the substrate, and a resistive coating on the second portion of the substrate.

As a termination for a coaxial conductor, the portion of the planar resistive element which is inserted into the slot in a centerline conductor provides a soft transition from the coaxial transmission mode to the TEM suspended substrate planar mode, thereby reducing the reflections caused by the termination. Further, the planar ground planes provide the low impedance required near the portion of the planar resistive element which is electrically interconnected to the ground planes.

As a termination for a stripline in a coupler, the planar resistive element is rotated ninety (90) degrees with respect to the plane of the stripline so that the stripline can be supported by the termination. In this configuration there is no mode change between the stripline and the termination; however, the ninety degree rotation of the stripline and the planar resistive element does cause field disturbances. Providing a semicircular ground plane in the region surrounding the junction of the stripline and the planar resistive element minimizes the effect of the field disturbances.

BRIEF DESCRIPTION OF THE DRAWING

FIG. 2 is an isometric view of a conventional coaxial termination;

FIG. 3 is a cross-sectional view of the junction of a coaxial and a planar conductor which creates a hard-mode change from the coaxial to the suspended planar mode;

DESCRIPTION OF THE PREFERRED EMBODIMENTS

Figure 4:
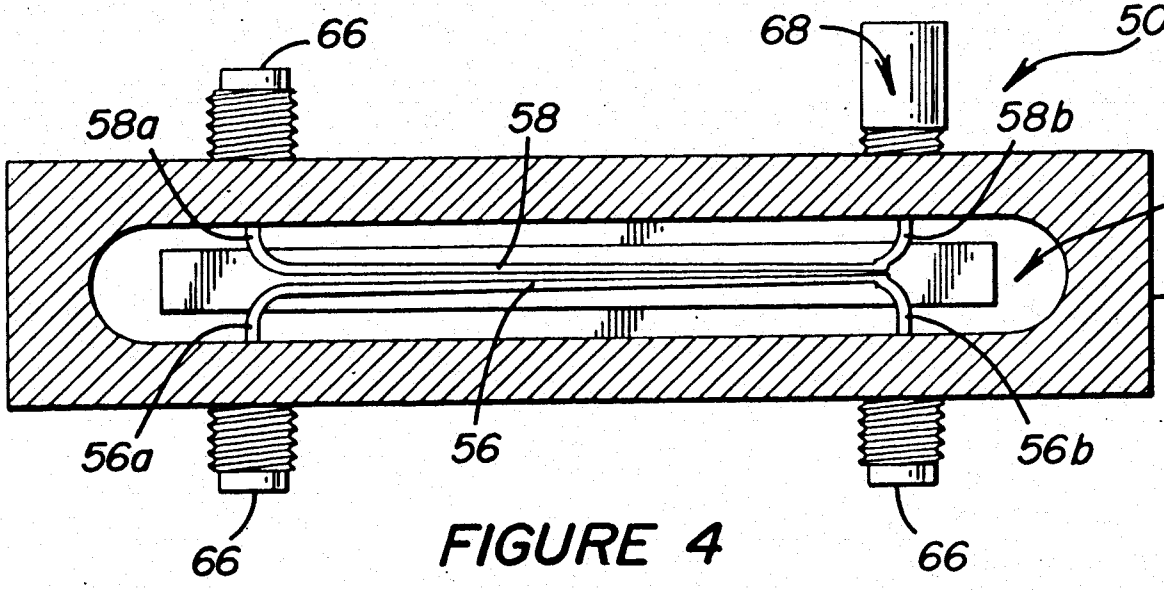
FIG. 4 is a plan view of a directional coupler in accordance with the present invention.

A directional coupler in accordance with the present invention will be described with reference to FIGS. 4, 5 and 6.

A directional coupler 50 in accordance with the present invention includes a ground body 52 having a cavity 54 provided therein. First and second stripline conductors 56, 58 are provided in the cavity, and ground body 52 and a cover 60 (see FIG. 5) provide substantially parallel ground planes above and below the first and second striplines 56, 58. The dielectric between the striplines 56, 58 and the ground planes 52 and 60 is air.

The ground planes provided by the body 52 and cover 60 of directional coupler 50 can be considered as infinite ground planes since the distance between first and second striplines 56, 58 and the sidewalls of cavity 54 is much larger than the distance between the first and second striplines 56, 58 and the ground planes provided by body 52 and cover 60.

First and second striplines 56, 58 are designed and machined to have the specific shape required for coupled transmission lines. FIG. 6 shows the shape of second stripline 58, including quarter wavelength sections defined by steps 62 in the stripline which are formed during the manufacture of a stripline. Stripline 56 has a design which is a mirror image of second stripline 58. Steps 62 are one cause of the difference in the propagation velocities of the odd and even modes.

In order to provide first and second striplines 56, 58 with the extremely small dimensions and to work within the tight tolerances ($\cong$0.00005") required for couplers operating at frequencies from 26 to 40 GHz and beyond, first and second striplines 56, 58 are fabricated using electro-discharge machining or lasers. Fabricating the striplines 56, 58 with these techniques provides the necessary dimensions and tolerances without distorting the striplines 56, 58 during the fabrication process.

Figure 5:
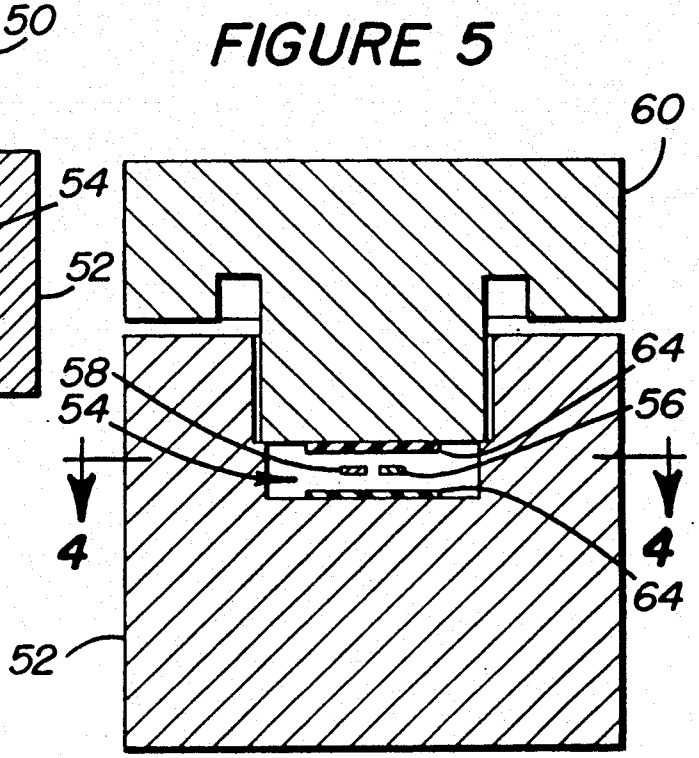
FIG. 5 is a cross-sectional view along line 4—4' of the directional coupler shown in FIG. 4.
Figure 6:
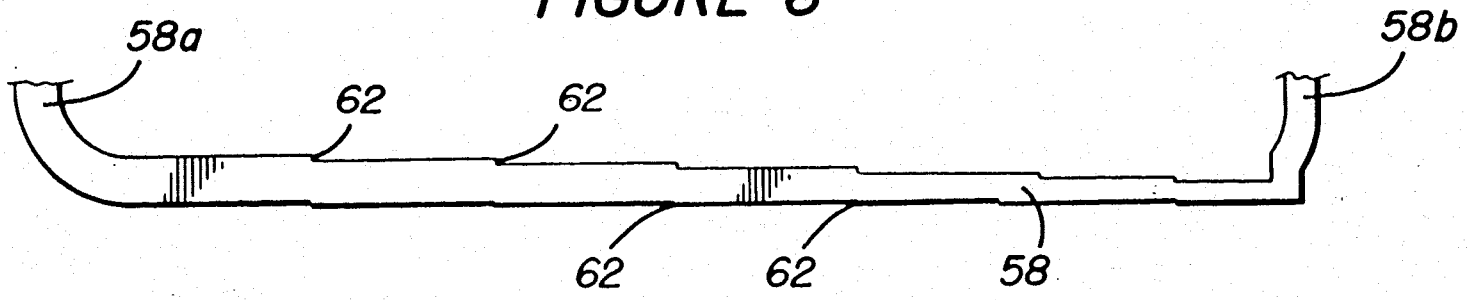
FIG. 6 is a plan view of a stripline conductor utilized in the directional coupler illustrated in FIG. 4.

To compensate for the differing propagation velocities $v_{pe}$ and $v_{po}$ of the even and odd modes caused by the stepped quarter wavelength sections in striplines 56, 58 and other factors, the propagation velocity of the even mode $v_{po}$ is slowed by providing a layer of a second dielectric material 64 (air being the first dielectric material) having a dielectric constant $\epsilon_r$ between the first and second striplines 56, 58 and each of the ground planes 52, 60 (as shown in FIG. 5), where $\epsilon_r$ is greater than the dielectric constant air $\epsilon_0$. Equalizing the propagation velocities of the odd and even modes by slowing the even mode propagation velocity provides couplers having a directivity of greater than 20 dB.

Second dielectric layers 64 are provided in the coupled region of striplines 56, 58. The thickness of second dielectric layers 64 may be adjusted in accordance with the design of the directional coupler in order to appropriately adjust the propagation velocity of the even mode. The preferred thickness of dielectric layers 64 ranges from 0.0005" to 0.0015". One material which has been utilized for dielectric layers 64 is Mylar brand plastic film with two Mylar brand plastic film layers each having a thickness of 0.0005" being combined to provide each dielectric layer 64 with a thickness 0.001". Other materials, for example polyethylene or Teflon, having dielectric constants $\epsilon_r$ ranging from 2.0 to 3.5 may be utilized as the second dielectric 64.

Coaxial connectors 66 are electrically interconnected with first and second ends **56*a*, 56*b* of first stripline 56 and first end 58*a* of second stripline 58. As shown in FIG. 4, connectors 66 connect the centerline conductor of the coaxial conductor attached thereto to the respective striplines 56, 58 and connect the ground conductor of the coaxial cable to the body 52 of directional coupler 50. A termination 68 is provided at second end 58*b* of second stripline 58**.

A termination for a coaxial conductor and a termination for a stripline, which is useful in the above-described directional coupler 50, both in accordance with the present invention, will be described with reference to FIGS. 7, 8, 9, and 10.

Figure 7:
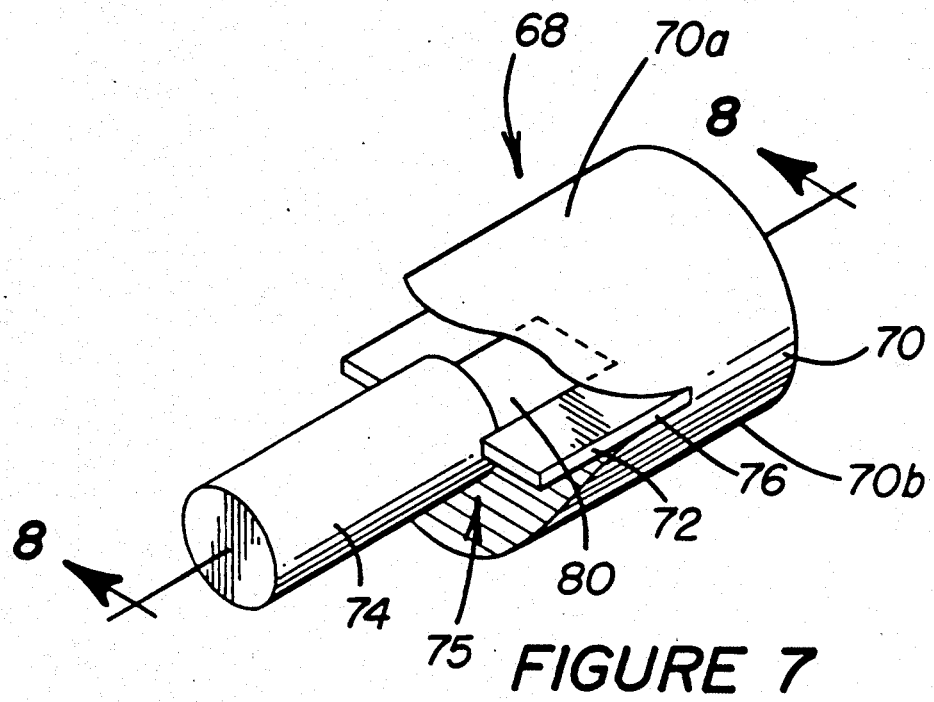
FIG. 7 is an isometric view of a planar termination for a coaxial conductor in accordance with the present invention.
Figure 8:
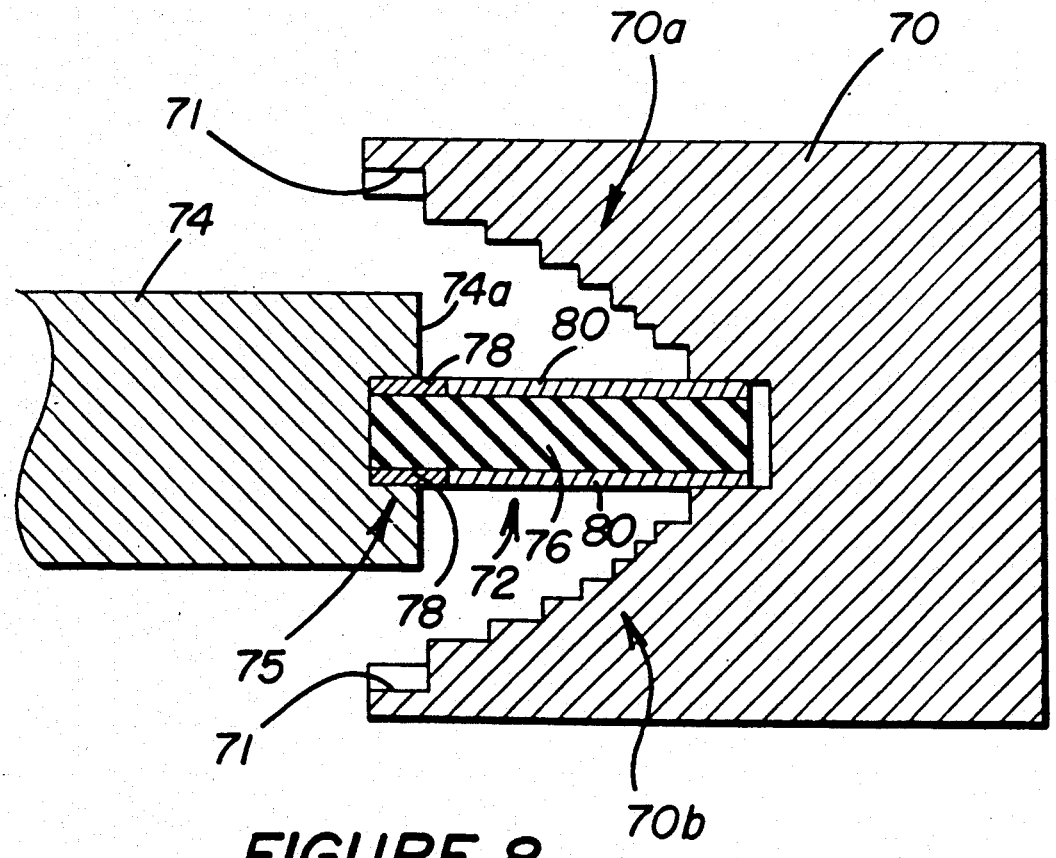
FIG. 8 is a cross-sectional view of a planar termination for a coaxial conductor in accordance with the present invention taken along line 7—7' of FIG. 7.
Figure 10:
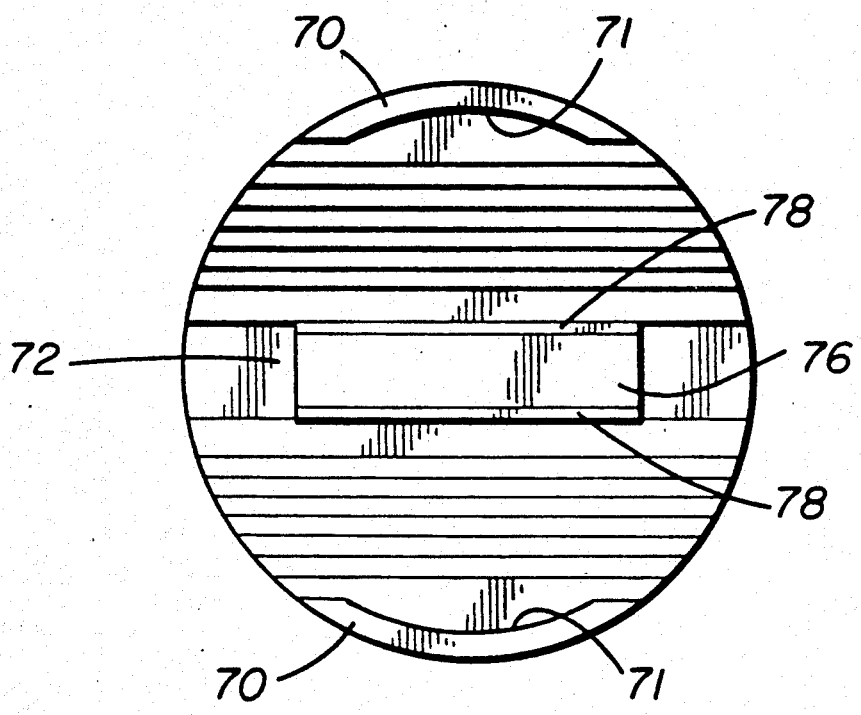
FIG. 10 is an end view of the planar termination for a coaxial conductor shown in FIGS. 7 and 8.

As shown in FIGS. 7 and 8, a planar termination 68 for a coaxial conductor includes an outer conductor (or ground plane) 70 including first and second ground planes **70*a* and 70*b* and resistive element 72 which electrically interconnects a conductor 74 and ground plane 70. Conductor 74 may be the centerline in a coaxial transmission line or another conductor which supports coaxial transmission, for example, a stripline in a directional coupler. In order to attenuate the impedance from the coaxial impedance $Z_0$ of conductor 74 to zero impedance of ground plane 70, the shape of ground plane 70 in the region of resistive element 72 must be carefully controlled. For example, the distance between the resistive element and the ground plane changes the capacitance of the portion of the transmission line provided by resistive element 72. The capacitance ($C=\epsilon_0 A/D$, where A is the area of resistive element 72 and D is the distance between resistive element 72 and ground plane 70) varies inversely with the separation between resistive element 72 and ground plane 70, and thus increases as ground plane 70 becomes closer and closer to resistive element 72. The impedance ($Z_0=\sqrt{L/C}$) varies inversely with the square root of capacitance; accordingly, as the capacitance increases impedance decreases. The parameters associated with attenuating the impedance are well known to those of ordinary skill in the art and will not be discussed further. Importantly, however, in a planar termination the fabrication of ground plane 70** is simplified since a step-like configuration can be provided instead of a smooth curve.

The planar termination for a coaxial conductor of the present invention improves upon the performance of conventional terminations for coaxial conductors by providing a soft mode change at the interface of the coaxial conductor 74 and resistive elements 72. The soft mode change is accomplished by creating a region in which both the coaxial transmission mode and the TEM suspended substrate planar mode are present. This region exists where resistive element 72 is inserted in a slot 75 at the terminal end 74*a* of conductor 74 and steps 71 (see FIG. 10) have a semicircular rather than planar configuration. The soft mode change prevents undesired reflections of signals transmitted by coaxial conductor 74 which would otherwise occur at the interface of coaxial conductor 74 and planar resistive element 72 when an abrupt or hard mode change, such as the mode change illustrated in FIG. 3, is utilized.

Resistive element 72 includes a substrate 76 formed of, for example, alumina ($Al_2O_3$), having first and second portions. The first portion of substrate 76 is provided with a conductive coating 78 of, for example, gold, and is inserted in the slot in conductor 74. The second portion of substrate 76 is provided with a resistive coating 80, for example, tantalum nitride ($TaN_3$) which electrically interconnects conductive coating 78 and ground plane 70.

Figure 1:
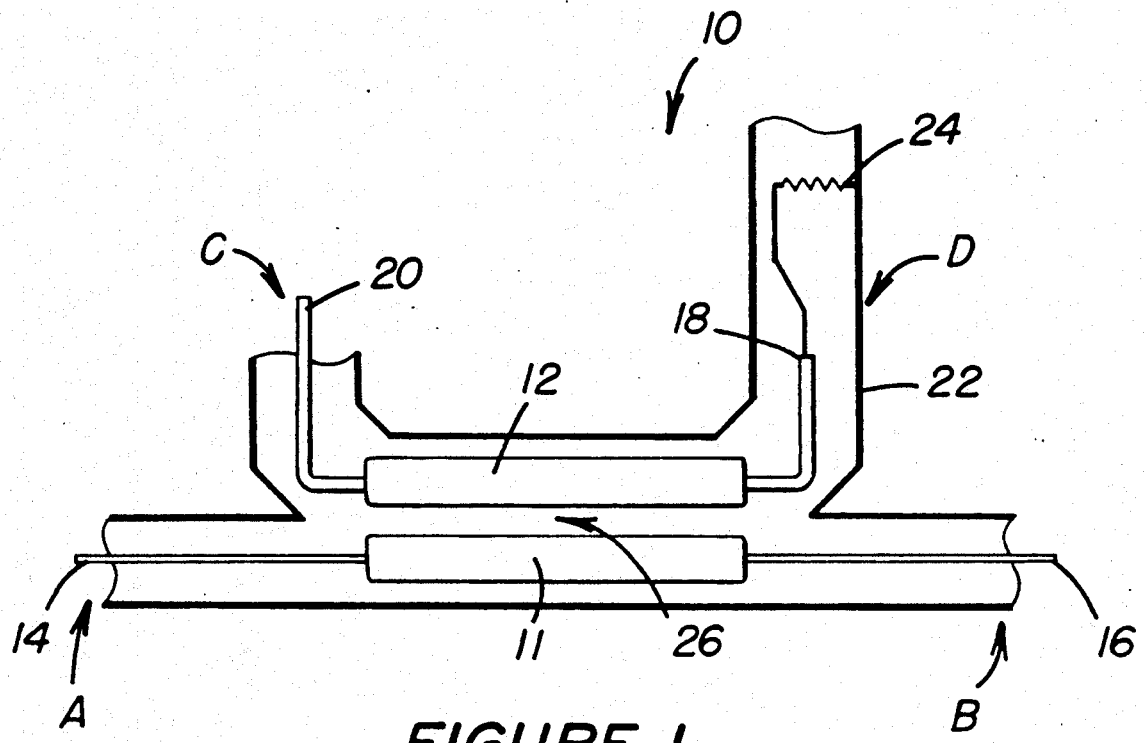
FIGURE 1 (Prior Art)
FIG. 1 is a plan view of a conventional directional coupler.
Figure 9:
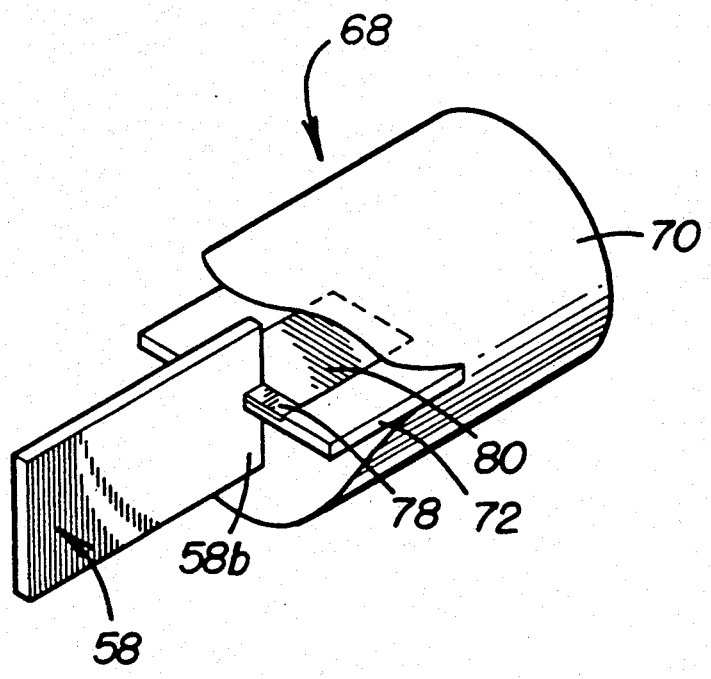
FIG. 9 is an isometric view of a planar termination for a stripline in accordance with the present invention.

As termination for a stripline in a directional coupler, as shown in FIG. 9, the ground body 70 of planar termination 68 is connected to body 52 (See FIG. 4) of directional coupler 50. A slot is provided in the second end 58*b* of stripline 58 into which resistive element 72 is inserted. Resistive element 72 is rotated ninety degrees with respect to the plane of stripline 58 to facilitate the insertion of planar resistive element 72 into the slot in stripline 58. Thus, termination 68 provides support for stripline 58 through the interconnection of stripline 58 and resistive element 72; therefore, the need for a support mechanism and the reflections caused by same are eliminated. There is no mode change between stripline 58 and resistive element 72. Field disturbances do occur at the junction of stripline 58 and planar resistive element 72; however, the circular shape of steps 71 of the ground planes in this region (FIG. 8) minimizes the effect of such field disturbances.

These present inventions allow coaxial couplers to be used at frequencies in excess of 40 GHz, with high performance and low directivity. The many features and advantages of the directional coupler and coaxial termination of the present invention will be apparent to those skilled in the art from the specification. Thus, the following claims are intended to cover all modifications and equivalents falling within the scope of the invention.

What is claimed is:

1. A termination for a coaxial conductor including a center conductor having a terminal end and having a slot provided in the terminal end of the center conductor, comprising:

first and second ground planes, each ground plane including a first portion having a linear cross section and a second portion having a semicircular cross section, said semicircular cross section of said second portion of each ground plane including a linear portion which is substantially parallel with the linear cross section of said first portion of each ground plane, said second portion of each ground plane having substantially parallel steps which decrease the distance between said ground planes; and a planar resistive element electrically interconnecting the center conductor and said first and second ground planes, said planar resistive element being provided between said first and second ground planes and having a first portion inserted into the slot in said center conductor, said first portion of said resistive element being provided between said second portions of said ground planes.

2. According to claim 1, wherein said planar resistive element comprises:

a substrate, a conductive coating provided on a portion of said substrate corresponding to said first portion of said planar resistive element, and a resistive coating provided on a second portion of said substrate.

3. A termination according to claim 1 wherein said termination supports the center conductor.

4. A termination for a stripline conductor having a terminal end and having a slot in the terminal end of the stripline conductor, comprising:

first and second planar ground planes; and a planar resistive element provided between said planar ground planes and inserted in said slot in said stripline conductor, for electrically interconnecting said stripline conductor and said ground planes, said planar resistive element comprising a substrate having first and second portions, a conductive coating provided on the first portion of said substrate, and a resistive coating provided on the second portion of said substrate, said first portion of said substrate being inserted into the slot in the stripline conductor.

5. A termination according to claim 4, wherein said planar ground planes have substantially parallel steps which decrease the distance between said ground planes and said resistive element.

6. A termination for a stripline conductor having a terminal end and having a slot in the terminal end of the stripline conductor comprising:

first and second planar ground planes; and a planar resistive element provided between said planar ground planes and inserted in said slot in said stripline conductor, for electrically interconnecting said stripline conductor and said ground planes, said termination supporting said stripline conductor.

7. A termination for a stripline conductor having a terminal end and having a slot in the terminal end of the stripline conductor, comprising:

first and second planar ground planes; and a planar resistive element provided between said planar ground planes and inserted in said slot in said stripline conductor, for electrically interconnecting said stripline conductor and said ground planes, said resistive element lying in a plane parallel with said first and second planar ground planes, said stripline conductor lying in a plane rotated ninety degrees with respect to the plane of said resistive element.

8. A termination according to claim 7, wherein said termination supports said stripline conductor.

9. A termination for a coaxial conductor, including a center conductor having a terminal end, a slot provided in the terminal end of the center conductor, and an outer conductor surrounding the center conductor, comprising:

first and second ground planes, each ground plane including a first portion having a semicircular cross section and a second portion having a linear cross section, said semicircular cross section of said first portion of each ground plane including a linear portion which is substantially parallel with the linear cross section of said second portion of each ground plane, said first and second ground planes being electrically interconnected with each other and with said outer conductor of said coaxial conductor, said first portion of each ground plane having substantially parallel steps which decrease the distance between said ground planes; and a resistive element providing a resistive, electrical interconnection between the center conductor and said first and second ground planes, respectively, said resistive element having first and second planar surfaces and being provided between said first and second ground planes so that said first and second planar surfaces of said resistive element face said first and second ground planes, respectively, a portion of said resistive element being inserted into the slot in said center conductor and provided between said first portions of said ground planes.

10. A termination according to claim 9, wherein said termination supports the center conductor inside of the outer conductor.

11. A termination for a coaxial conductor, comprising:

conductor means for transmitting signals in a coaxial transmission mode, said conductor means including a center conductor having a terminal end and a slot in the terminal end;

termination means for resistively, electrically interconnecting said conductor means to a ground potential to absorb the signals transmitted by said conductor means, and for creating a region in which both the coaxial transmission mode and a TEM suspended substrate planar transmission mode are present.

* * * * *